US011300366B2

(12) United States Patent
Dahlberg et al.

(10) Patent No.: US 11,300,366 B2
(45) Date of Patent: Apr. 12, 2022

(54) HEAT EXCHANGER HAVING AN INTEGRATED SUCTION GAS HEAT EXCHANGER

(71) Applicant: SWEP International AB, Landskrona (SE)

(72) Inventors: Tomas Dahlberg, Helsingborg (SE); Sven Andersson, Hasseleholm (SE)

(73) Assignee: SWEP International AB, Landskrona (SE)

( * ) Notice: Subject to any disclaimer, the term of this patent is extended or adjusted under 35 U.S.C. 154(b) by 10 days.

(21) Appl. No.: 16/615,707

(22) PCT Filed: May 22, 2018

(86) PCT No.: PCT/EP2018/063327
§ 371 (c)(1),
(2) Date: Nov. 21, 2019

(87) PCT Pub. No.: WO2018/215426
PCT Pub. Date: Nov. 29, 2018

(65) Prior Publication Data

US 2020/0173736 A1 Jun. 4, 2020

(30) Foreign Application Priority Data

May 22, 2017 (SE) ..... 1750633-8

(51) Int. Cl.
*F28F 3/00* (2006.01)
*F28F 3/04* (2006.01)
*F28F 9/02* (2006.01)

(52) U.S. Cl.
CPC ..... *F28F 3/04* (2013.01); *F28F 9/02* (2013.01); *F28F 2275/04* (2013.01)

(58) Field of Classification Search
CPC .. F28F 3/04; F28F 9/02; F28F 2275/04; F28F 3/005; F28F 3/046; F28D 9/0037; F28D 9/0093; F28D 9/005
See application file for complete search history.

(56) References Cited

U.S. PATENT DOCUMENTS 6,564,862 B1 5/2003 Persson
2006/0191674 A1 8/2006 Persson
(Continued)

FOREIGN PATENT DOCUMENTS

CN 1148117 A 4/1997
CN 102980328 A 3/2013
(Continued)

OTHER PUBLICATIONS

International Search Report for International Application No. PCT/EP2018/063327 dated Jul. 30, 2018 (2 pages).
(Continued)

*Primary Examiner* — Harry E Arant
(74) *Attorney, Agent, or Firm* — Merchant & Gould P.C.

(57) ABSTRACT

A brazed plate heat exchanger (100; 200) comprises a number of heat exchanger plates (120*a*-120*h;* 201-204) provided with a pressed pattern of ridges (R) and grooves (G) adapted to keep the plates on a distance from one another by providing contact points between crossing ridges (R) and grooves (G) of neighbouring plates under formation of interplate flow channels for media to exchange heat, said interplate flow channels being in selective fluid communication with first, second, third and fourth large port openings (O1, O2, O3, O4; 210*a,* 210*b,* 210*c,* 210*d*) and first and second small port openings (SO1, SO2) for letting in fluids to exchange heat, characterized in that fluid passing between the first and second large port openings (O1, O2; 210*a,* 210*b*) exchanges heat with fluids passing between third and fourth port openings (O3, O4; 210*c,* 210*d*) over a first heat
(Continued)

exchanging portion of each plate and fluid passing between the first and second small port openings (SO1, SO2) over a second portion of each plate.

3 Claims, 11 Drawing Sheets

(56) References Cited

U.S. PATENT DOCUMENTS

| | | | | |
|---|---|---|---|---|
| 2013/0224613 | A1 | 8/2013 | Vanderwees et al. | |
| 2015/0362269 | A1 * | 12/2015 | Andersson | F28F 9/026 165/166 |
| 2017/0030255 | A1 | 2/2017 | Tokozakura | |

FOREIGN PATENT DOCUMENTS

| | | | | |
|---|---|---|---|---|
| CN | 105066729 | A | 11/2015 | |
| FR | 3001795 | A1 | 8/2014 | |
| JP | 2012112591 | A | 6/2012 | |
| WO | WO-2010108907 | A1 * | 9/2010 | F28F 9/26 |
| WO | 2014125089 | A1 | 8/2014 | |

OTHER PUBLICATIONS

Chinese Office Action for CN Application No. 201880034221.7 dated Jul. 21, 2021 (9 pages), with translation.

* cited by examiner

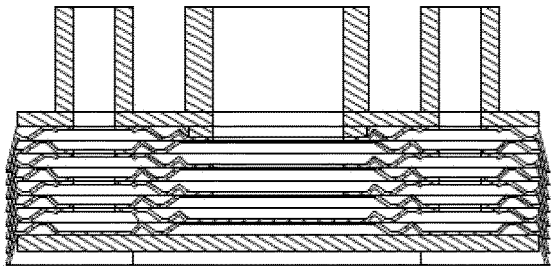
Fig. 1c
Fig. 1b
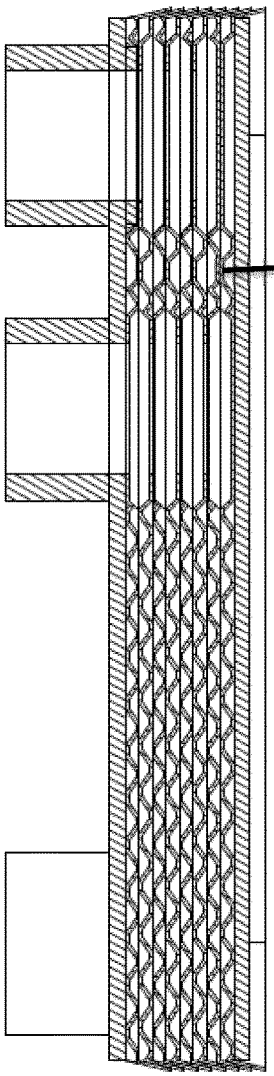
Fig. 1a
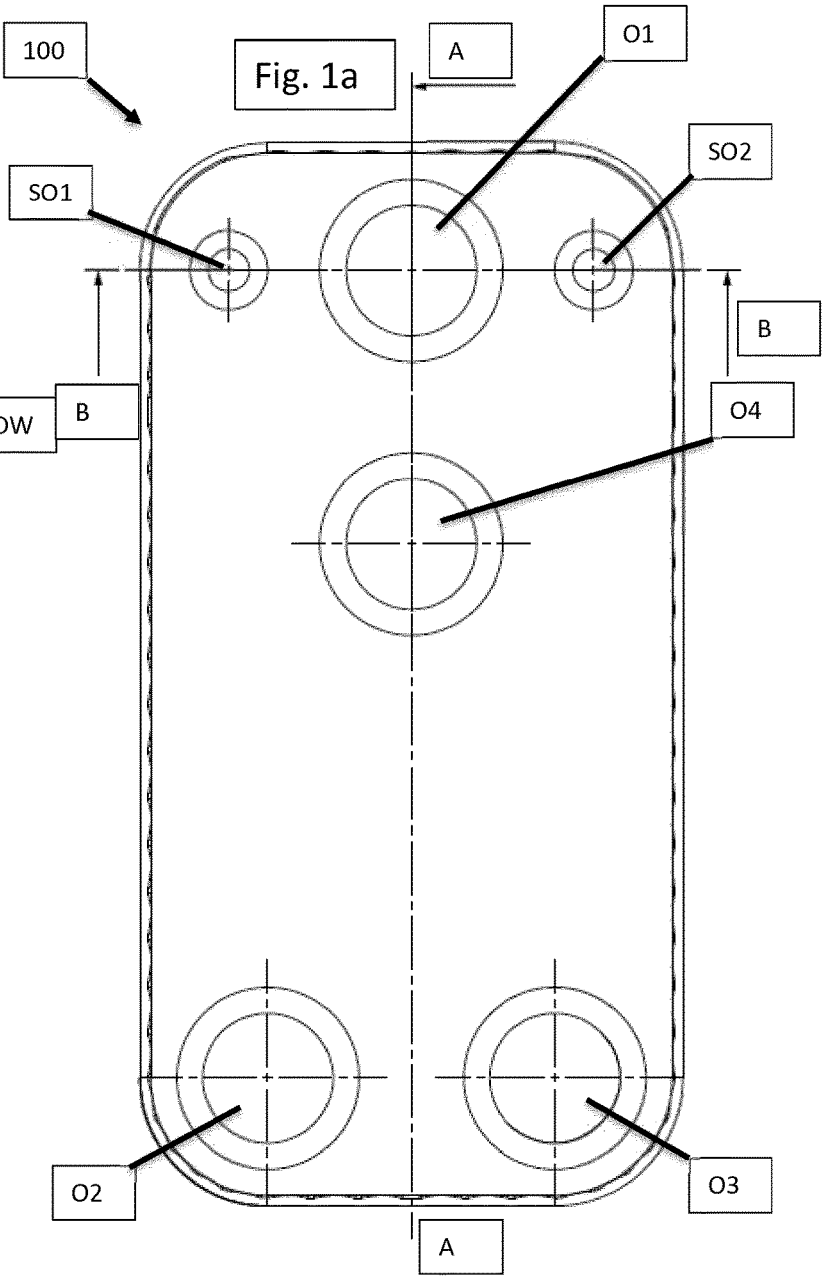

HEAT EXCHANGER HAVING AN INTEGRATED SUCTION GAS HEAT EXCHANGER

This application is a National Stage Application of PCT/EP2018/063327, filed 22 May 2018, which claims benefit of Serial No. 1750633-8, filed 22 May 2017 in Sweden and which applications are incorporated herein by reference. To the extent appropriate, a claim of priority is made to each of the above disclosed applications.

TECHNICAL FIELD

A brazed plate heat exchanger comprising a number of rectangular or square heat exchanger plates provided with a pressed pattern of ridges and grooves adapted to keep the plates on a distance from one another by providing contact points between crossing ridges and grooves of neighbouring plates under formation of interplate flow channels for media to exchange heat, said interplate flow channels being in selective fluid communication with first, second, third and fourth large port openings and first and second small port openings for letting in fluids to exchange heat.

PRIOR ART

In the art of refrigeration, so-called "suction gas heat exchange" is a method for improving e.g. stability of a refrigeration system. In short, suction gas heat exchange is achieved by providing for a heat exchange between warm liquid, high pressure refrigerant from a condenser outlet and cold gaseous refrigerant from an evaporator outlet. By the suction gas heat exchange, the temperature of the cold gaseous refrigerant will increase, while the temperature of the warm liquid will decrease. This has two positive effects: First, problems with flash boiling after the warm liquid has passed a subsequent expansion valve will decrease; Second, the risk of droplets in the gaseous refrigerant leaving the evaporator will decrease.

Suction gas heat exchange is well known. Often, suction gas heat exchange is achieved by simply brazing or soldering pipes carrying refrigerant between which heat exchange is desired to one another. This way of achieving the heat exchange is, however, costly in terms of refrigerant volume required—it is always beneficial if the piping between different components of a refrigeration system is as short as possible. Suction gas heat exchange by brazing or soldering piping carrying fluids having different temperatures together necessitates longer piping than otherwise would be the case—hence, the internal volume of the piping will increase, requiring more refrigerant in the refrigeration system. This is detrimental not only from an economical point of view, but also since the amount of refrigerant is limited in several jurisdictions.

Another option is to provide a separate heat exchanger for the suction gas heat exchange. Separate heat exchangers are more efficient than simply brazing different piping portions to one another, but the provision of a separate heat exchanger also necessitates piping connecting the evaporator and the condenser to the suction gas heat exchanger, which piping will increase the refrigerant volume of the refrigeration system.

Moreover, refrigeration systems are often required to operate in both heating mode and in cooling mode, depending on the required/desired load. Usually, the shift between heating and chilling mode is achieved by shifting a four-way valve such that an evaporator becomes a condenser and a condenser becomes an evaporator. Unfortunately, this means that the heat exchange in either or both of the condenser/evaporator units will be a co-current heat exchange, i.e. a heat exchange wherein the media to exchange heat travels in the same general direction, in either heating or cooling mode. As well known by persons skilled in the art, a co-current heat exchange is inferior to a counter-current heat exchange. In evaporators, a decrease of heat exchanging performance might lead to an increased risk of droplets in the refrigerant vapor that leaves the heat exchanger. Such droplets might seriously damage a compressor and are thus highly undesirable. However, devices to shift the flow direction of the medium to exchange heat with the refrigerant in the evaporator are costly and add complexity to the refrigeration system.

It is the object of the present invention to solve or at least mitigate the above and other problems.

SUMMARY

The above and other problems are solved, or at least mitigated, by a brazed plate heat exchanger comprising a number of rectangular or square heat exchanger plates provided with a pressed pattern of ridges and grooves adapted to keep the plates on a distance from one another by providing contact points between crossing ridges and grooves of neighbouring plates under formation of interplate flow channels for media to exchange heat, said interplate flow channels being in selective fluid communication with first, second, third and fourth large port openings and first and second small port openings for letting in fluids to exchange heat. Fluid passing between the first and second large port openings exchanges heat with fluids passing between third and fourth port openings over a first heat exchanging portion of each plate and fluid passing between the first and second small port openings over a second portion of each plate. The first and second portions are divided by a dividing surface extending between neighbouring sides of the rectangular or square heat exchanger plates.

The dividing surface may comprise a ridge of one heat exchanger plate and a groove of its neighboring plate, such that a seal between the plates is achieved when the ridge of the one heat exchanger plate contacts the groove of the neighbouring heat exchanger plate and no seal is achieved when the ridge of the one heat exchanger plate does not contact the groove of its neighboring plate.

In order to get an as even flow as possible between the small openings, the second portion may extend along a radius of a part of a port opening.

BRIEF DESCRIPTION OF THE DRAWINGS

In the following, the invention will be described with reference to appended drawings, wherein:

FIG. 1*a* is a plan view of a heat exchanger according to one embodiment;

FIG. 1*b* is a section view of the heat exchanger of FIG. 1*a* taken along the line A-A;

FIG. 1*c* is a section view of the heat exchanger of FIG. 1*a* taken along the line B-B;

DESCRIPTION OF EMBODIMENTS

Figure 2:
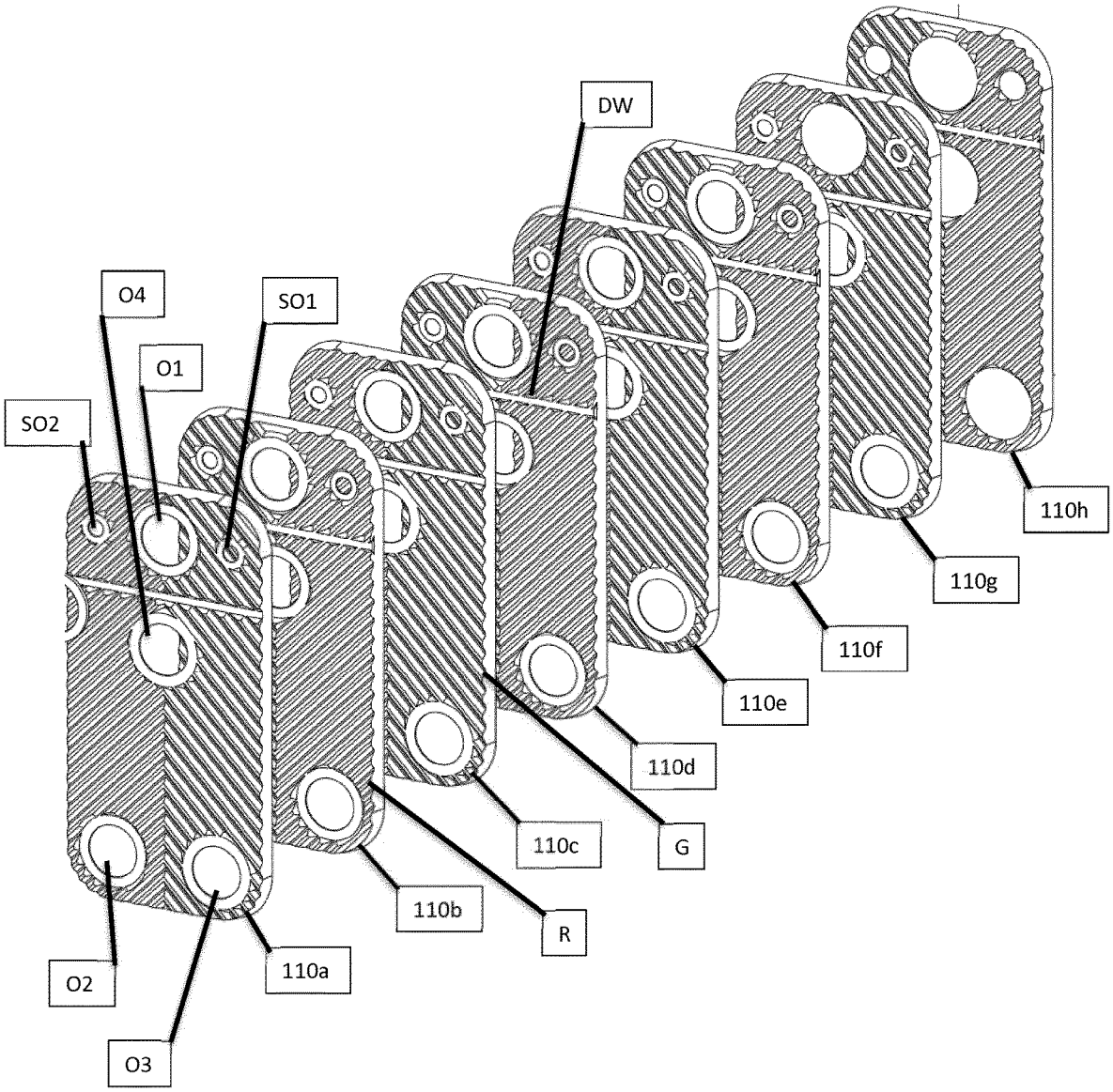
FIG. 2 is an exploded perspective view of the heat exchanger of FIG. 1.

In FIGS. 1*a*-2, a brazed heat exchanger 100 having a second heat exchanging portion usable as an integrated suction gas heat exchanger portion is shown. The heat exchanger 100 is made from sheet metal plates 110*a*-110*g* stacked in a stack to form the heat exchanger 100 and provided with a pressed pattern of ridges R and grooves G adapted to keep the plates on a distance from one another under formation of interplate flow channels for media to exchange heat. Large port openings O2 and O3 are provided near corners of each heat exchanger plate, whereas large openings O1 and O4 are provided centrally close to a short side of each heat exchanger plate. Areas surrounding the port openings O1 to O4 are provided at different heights such that selective communication between the port openings and the interplate flow channels is achieved. In the heat exchanger 100, the areas surrounding the port openings are arranged such that the large openings O1 and O2 are in fluid communication with one another by some plate interspaces, whereas the openings O3 and O4 are in fluid communication with one another by neighboring plate interspaces.

The heat exchanger plates 110*a*-110*g* are also provided with a dividing surface DW extending from one long side of each heat exchanger plate to the other longside thereof.

A heat exchanger plate 110*h*, placed at an end of the stack of heat exchanger plates, is not provided with port openings. This is in order to provide a seal for the port openings, such that fluid introduced at one end of the plate stack does not immediately escape the plate pack at the other sided thereof, but is forced into a connection (not shown) or into the interplate flow channels. In all other aspects, the heat exchanger plate 110*h* is identical to the heat exchanger plates 110*a*-110*g*.

With special reference to FIG. 2, a number of heat exchanger plates 210*a*-210*h* are shown. Each of the heat exchanger plates, except the heat exchanger plate 210*h*, is provided with port openings O1, O2, O3, O4, SO1 and SO2. The port openings are surrounded by areas provided at different levels, such that selective communication is provided between the port openings and the interplate flow channels formed between neighbouring heat exchanger plates, as mentioned above. Moreover, each of the heat exchanger plate is surrounded by a skirt S, which extends generally perpendicular to a plane of the heat exchanger plate and is adapted to contact skirts of neighbouring plates in order to provide a seal along the circumference of the heat exchanger.

In order to seal the interplate flow channel for fluid flow between the large port openings O4 and O3, a dividing surface DW is provided between long sides of the heat exchanger plates. The dividing surface DW comprises an elongate flat surface provided on different heights of different plates; when the surfaces of neighbouring plates contact one another, the channel will be sealed, whereas it will be open if they do not. In the present case, the dividing surface DW is provided at the same height as the areas surrounding the large port openings O1 and O2, meaning that for interplate flow channels fluidly connecting large port openings O1 and O2, the dividing surface will be open, whereas for the flow channel fluidly connecting the large port openings O3 and O4, the dividing surface will block fluid in this plate interspace.

Since the dividing surface DW will block fluid flow in the plate interspace communicating with the large port openings O3 and O4, there will be separate interplate channels on either side of the dividing surface DW. The interplate flow channel on the side of the dividing surface DW not communicating with the large opening O3 and O4 communicates with two small port opening SO1 and SO2. It should be noted that the dividing surface DW does not block the interplate flow channels communicating with the large port openings O1 and O2; hence, medium flowing in the interplate flow channels communicating with the small port openings SO1 and SO2 will exchange heat with med medium flowing in the flow channels communicating with the large openings O1 and O2—just like medium flowing in the interplate flow channels communicating with the large port openings O3 and O4.

In the embodiment shown in FIG. 2, the dividing surface DW extends in a straight line from one long side to the other—opposite—long side of the heat exchanger plates 110*a*-*h*, passing between large port openings O1 and O4. The small openings SO1 and SO2 are situated on either sides of the large port opening O1. It should be noted that the large port opening O1 is placed such that medium flowing in the interplate flow channel communicating with the small port openings SO1 and SO2 may pass on both sides of the large port opening O1. This arrangement is beneficial in that the port opening O1 will have an even temperature along its circumference.

Figure 3:
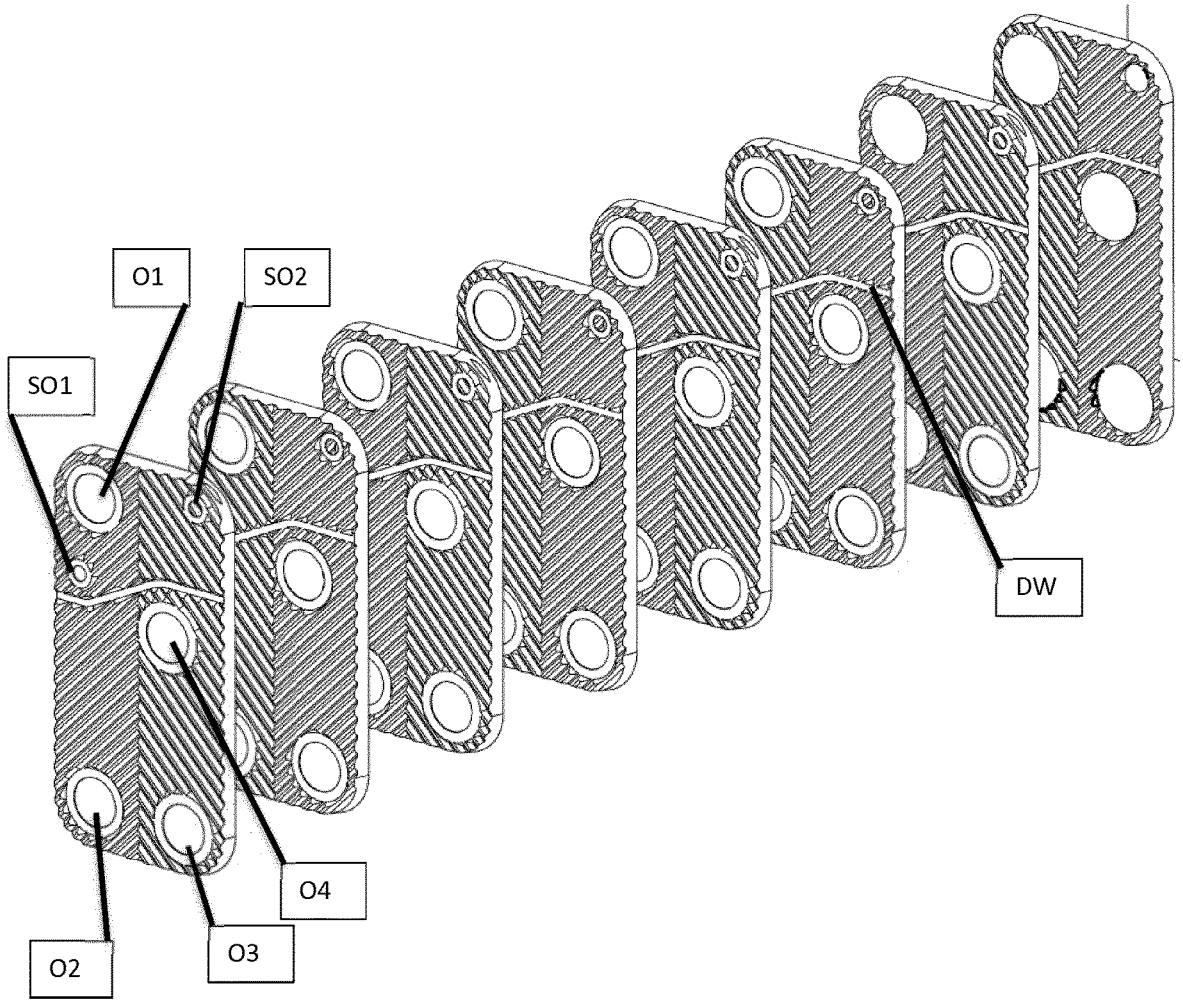
FIG. 3 is an exploded perspective view of a heat exchanger according to another embodiment.

In an embodiment shown in FIG. 3, the dividing surface does not extend in a straight line, but is slightly bent away from the port opening O1, which is placed near a corner of the heat exchanger. This provides for a more uniform flow area from the small opening SO1 to the small opening SO2.

Figure 4:
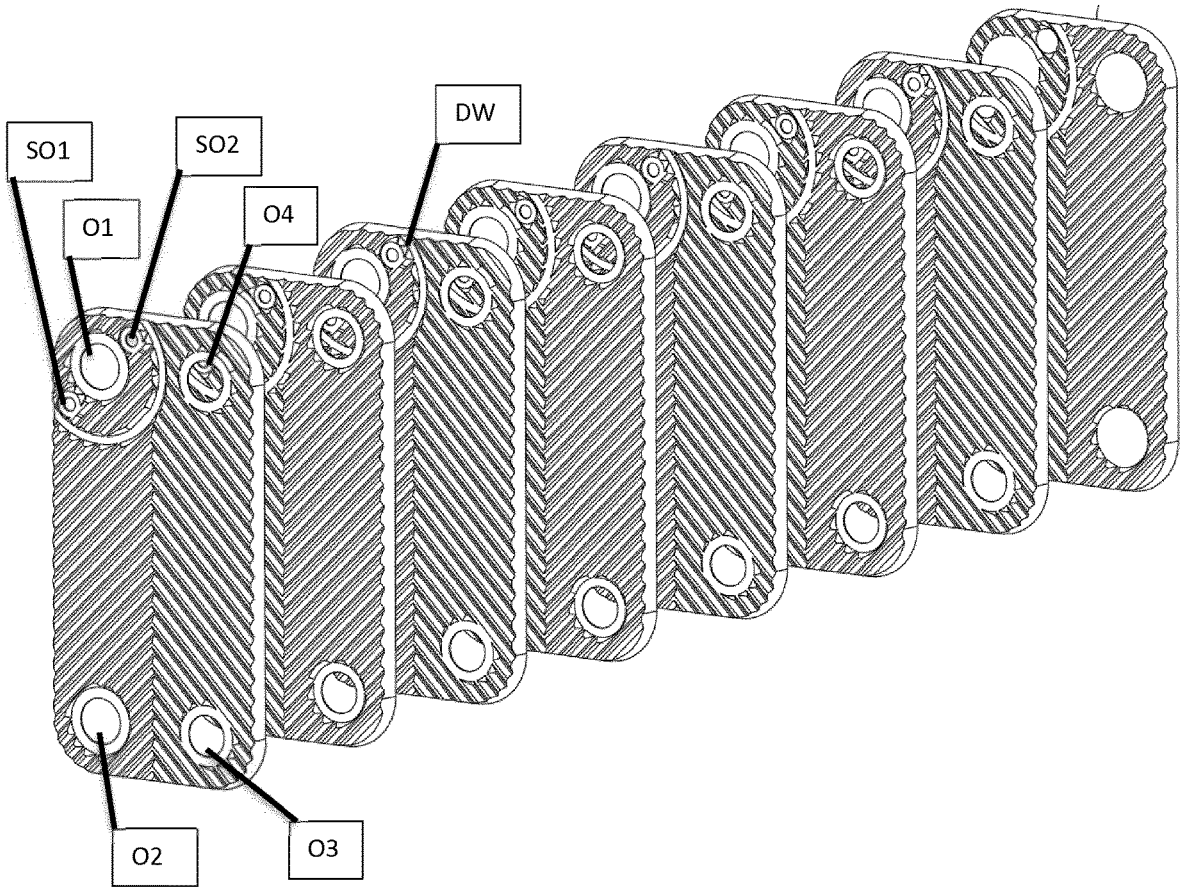
FIG. 4 is an exploded perspective view of heat exchanger according to another embodiment.

In an embodiment shown in FIG. 4, the dividing portion extends in a semi-circular fashion around the port opening O1. This embodiment is beneficial in that the large port openings O1-O4 may be placed close to the corners of the heat exchanger, hence providing for a large heat exchanging area. This embodiment is also beneficial in that the flow area of the interplate flow channel on the side of the dividing surface DW not communicating with the large opening O3 and O4 will have an even cross section all the way between the small opening SO1 and the small opening SO2. Please note that the dividing surface of FIG. 4 does not extend between opposing sides of the heat exchanger plates, but between neighbouring sides thereof.

Figure 5:
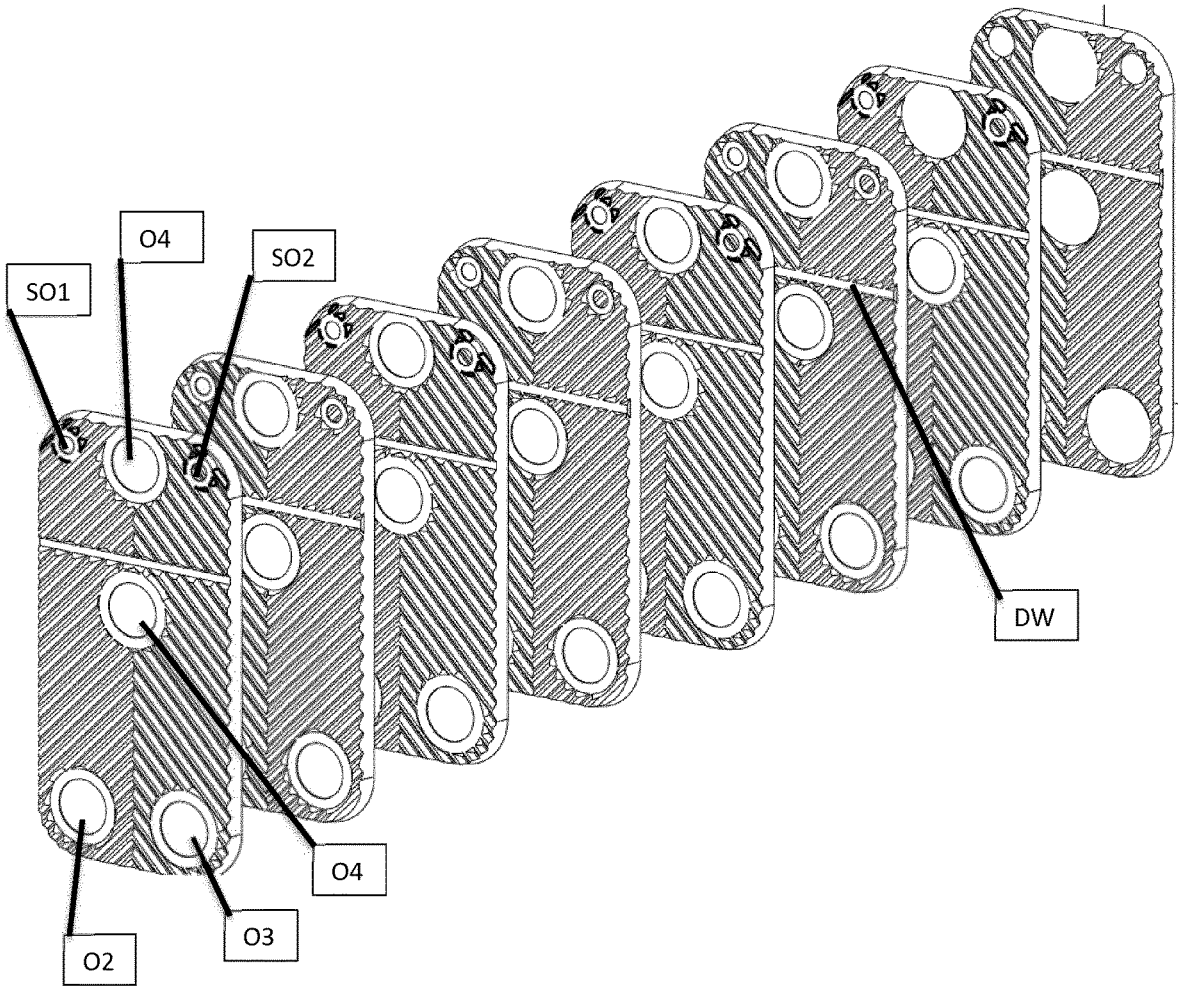
FIG. 5 is an exploded perspective view of a heat exchanger according to another embodiment.

In FIG. 5, an embodiment resembling the embodiment of FIG. 2 is shown. Just like the previously shown embodiment, the dividing surface DW extends in a straight line from one longside of the heat exchanger to the other, passing between large port openings O1 and O4. The small openings SO1 and SO2 are situated on either sides of the large port opening O1. However, the large port opening O1 is located and arranged such that no fluid may pass between the large port opening O1 and the short side of the heat exchanger. This is beneficial in that the heat exchange between fluid flowing between the small openings SO1 and SO2 and fluid about to exit the heat exchanger through the large opening O1 is improved, since the "dead area" between the port opening O1 and the short side of the heat exchanger is avoided.

Figure 6:
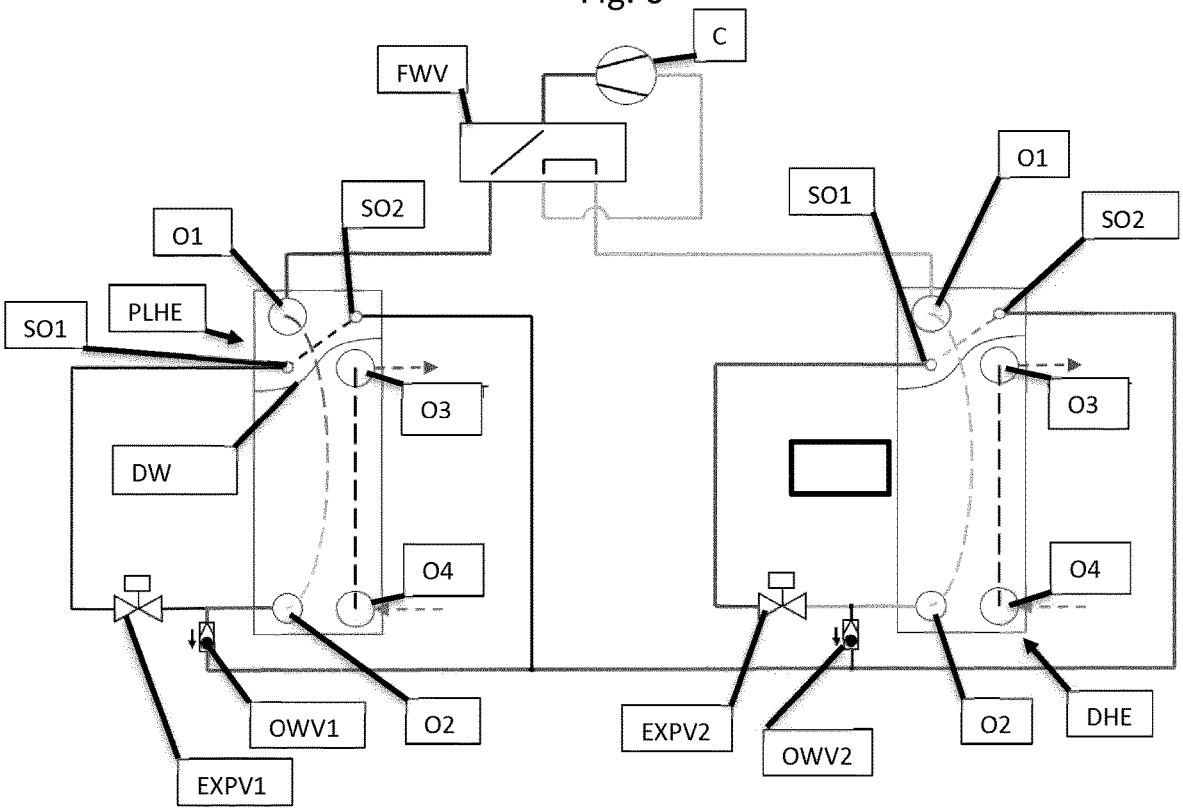
FIG. 6 is a schematic view of one embodiment of a reversible refrigeration system shown in a heating mode.
Figure 7:
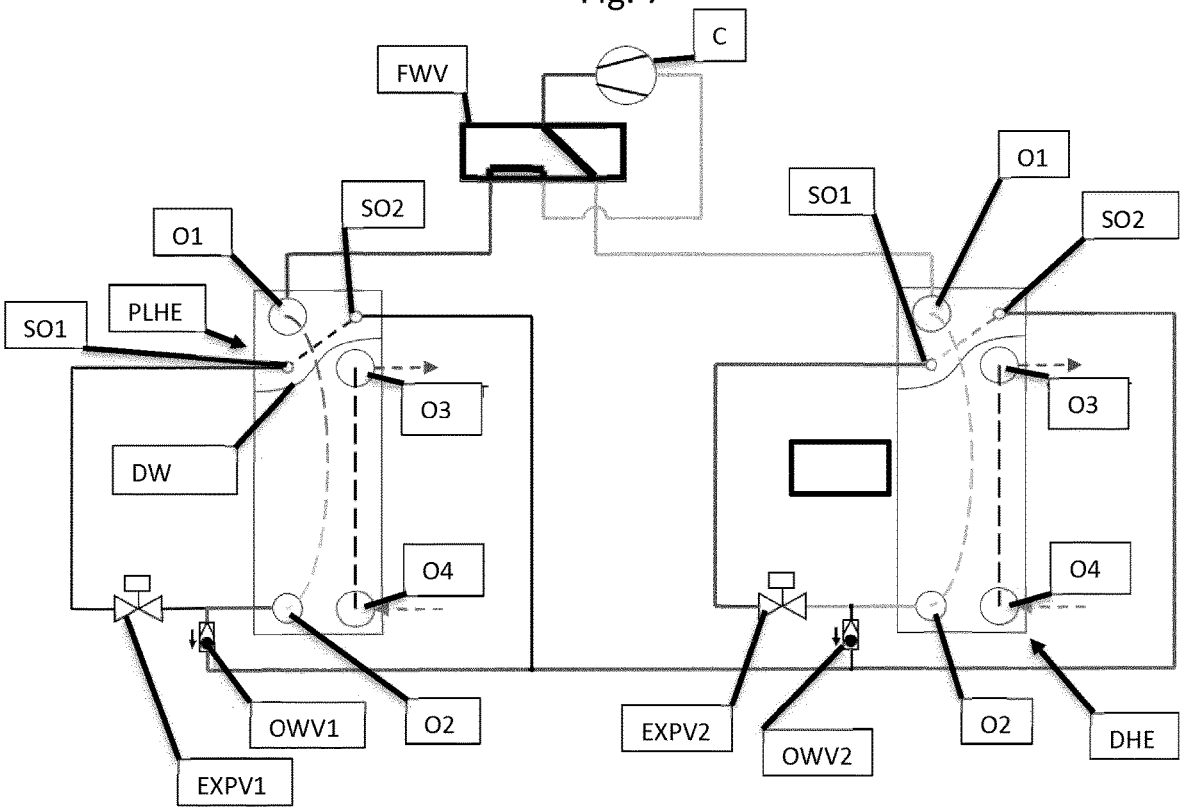
FIG. 7 is a schematic view of the reversible refrigeration system of FIG. 6 shown in a cooling mode.

In FIGS. 6 and 7, a preferred embodiment of a chiller system that can use a heat exchanger according to any of the above heat exchanger embodiments is shown in in heating mode and cooling mode, respectively.

The chiller system according to the first embodiment comprises a compressor C, a four-way valve FWV, a pay-load heat exchanger PLHE connected to a brine system requiring heating or cooling, a first controllable expansion valve EXPV1, a first one-way valve OWV1, a dump heat exchanger DHE connected to a heat source to which undesired heat or cold could be dumped, a second expansion valve EXPV2 and a second one-way valve OWV2. The heat exchangers PLHE and DHE are each provided with the four large openings O1-O4 as disclosed above and the two small openings SO1 and SO2, wherein the large openings O1 and O2 of each heat exchanger communicate with one another, the large openings O3 and O4 of each heat exchanger communicate with one another and wherein the small openings SO1 and SO2 of each heat exchanger communicate with one another. Heat exchange will occur between fluids flowing from O1 to O2 and fluids flowing between O3 and O4 and SO1 and SO2. There will, however, be no heat exchange between fluids flowing from O3 to O4 and fluids flowing from SO1 to SO2.

In heating mode, shown in FIG. 6, the compressor C will deliver high pressure gaseous refrigerant to the four-way valve FWV. In this heating mode, the four-way valve is controlled to convey the high pressure gaseous refrigerant to the large opening O1 of the payload heat exchanger PLHE. The high pressure, gaseous refrigerant will then pass the payload heat exchanger PLHE and exit at the large opening O2. While passing the pay-load heat exchanger PLHE, the high pressure gaseous refrigerant will exchange heat with a brine solution connected to a pay-load requiring heating and flowing from the large opening O4 to the large opening O3, i.e. in a counter flow direction compared to the refrigerant, which flows from the large opening O1 to the large opening O2. While exchanging heat with the brine solution, the high pressure gaseous refrigerant will condense, and when exiting the Pay-load heat exchanger PLHE through the large opening O2, it will be fully condensed, i.e. be in the liquid state.

In the heating mode, the first expansion valve EXPV1 will be fully closed, and the flow of liquid refrigerant exiting the pay-load heat exchanger will pass the first one-way valve OWV1, which allows for a refrigerant flow in this direction, while it will block flow in the other direction (which will be explained later in connection to the description of the cooling mode).

After having passed the first one-way valve OWV1, the liquid refrigerant (still comparatively hot) will enter the small opening SO2 of the dump heat exchanger DHE, and exit the heat exchanger through the small opening SO1. During the passage between the small openings SO and SO1, the temperature of the refrigerant will drop significantly due to heat exchange with cold, primarily gaseous refrigerant about to exit the dump heat exchanger DHE.

After leaving the dump heat exchanger DHE through the small opening SO1, the liquid refrigerant will pass the second expansion valve EXPV2, where the pressure of the refrigerant will drop, causing flash boiling of some of the refrigerant, which immediately will cause the temperature to drop. From the second expansion valve, the refrigerant will pass a branch connected to both the second one-way valve OWV2, which is connected between the high pressure side and the low pressure side of the refrigerant circuitry and closed for refrigerant flow due to the pressure difference between the high pressure side and the low pressure side. After having passed the branch, the cold, low pressure semi liquid refrigerant will enter the large opening O2 and pass the dump heat exchanger DHE under heat exchange with a brine solution connected to a source from which low temperature heat can be collected, e.g. an outside air collector, a solar collector or a hole drilled in the ground. Due to the heat exchange with the brine solution, which flows from the large opening O4 to the large opening O3, the primarily liquid refrigerant will vaporize. The heat exchange between the brine solution and the refrigerant will take place under co-current conditions, which is well known to give an inferior heat exchange performance as compared to counter-current heat exchange.

Just prior to the exiting the dump heat exchanger DHE through the large opening O1, the refrigerant (now almost completely vaporized) will exchange heat with the comparatively hot, liquid refrigerant that entered the dump heat exchanger through the small opening SO2 and exited the dump heat exchanger through the small port opening SO1. Consequently, the temperature of the refrigerant about to exit the dump heat exchanger DHE through the opening O1 will increase, hence ensuring that all of this refrigerant is completely vaporized.

It is well known by persons skilled in the art that co-current heat exchange is inferior to counter-current heat exchange. However, due to the provision of the heat exchange between the relatively hot liquid brine entering the small opening SO2 and the mainly gaseous refrigerant about to leave the dump heat exchanger DHE (i.e. a so-called "suction gas heat exchange"), it is not necessary to vaporize the refrigerant completely during the brine-refrigerant heat exchange. Instead, the refrigerant may be only semi-vaporized when it enters the suction gas heat exchange with the hot liquid refrigerant, since the remaining liquid phase refrigerant will evaporate during this heat exchange. It is well known that liquid-to-liquid heat exchange is much more efficient than gas-to-liquid heat exchange. Hence, the somewhat worse heat exchange caused by the co-current heat exchange mode will be compensated for.

From the opening O1 of the dump heat exchanger, the gaseous refrigerant will enter the four-way valve FWV, which is controlled to direct the flow of gaseous refrigerant to the compressor, in which the refrigerant is compressed again.

In FIG. 7, the chiller system is shown in cooling mode. In order to switch mode from heating mode to cooling mode, the four-way valve FWV is controlled such that the compressor feeds compressed gaseous refrigerant to the opening O1 of the dump heat exchanger DHE. The expansion valve EXPV2 will be entirely closed, the one-way valve OWV2 will be open, the one-way valve OWV1 will be closed and the expansion valve EXPV1 will be open to control the pressure before and after the refrigerant has passed the expansion valve EXPV1.

Hence, in cooling mode, the dump heat exchanger will function as a co-current condenser, and the "suction gas heat exchanger" thereof will not perform any heat exchange, whereas the pay-load heat exchanger PLHE will function as a co-current condenser. However, due to the provision of the suction gas heat exchange between the hot liquid refrigerant and semi-vaporized refrigerant about to leave the pay-load heat exchanger PLHE, the efficiency of the co-current heat exchange can be maintained at acceptable levels.

It should be noted that the suction gas heat exchanging parts are integrated with the dump heat exchanger DHE and that the pay-load heat exchanger PLHE in FIGS. 6 and 7. In other embodiments, however, the suction gas heat exchangers may be separated from the dump heat exchanger and/or the pay-load heat exchanger.

Figure 7B:
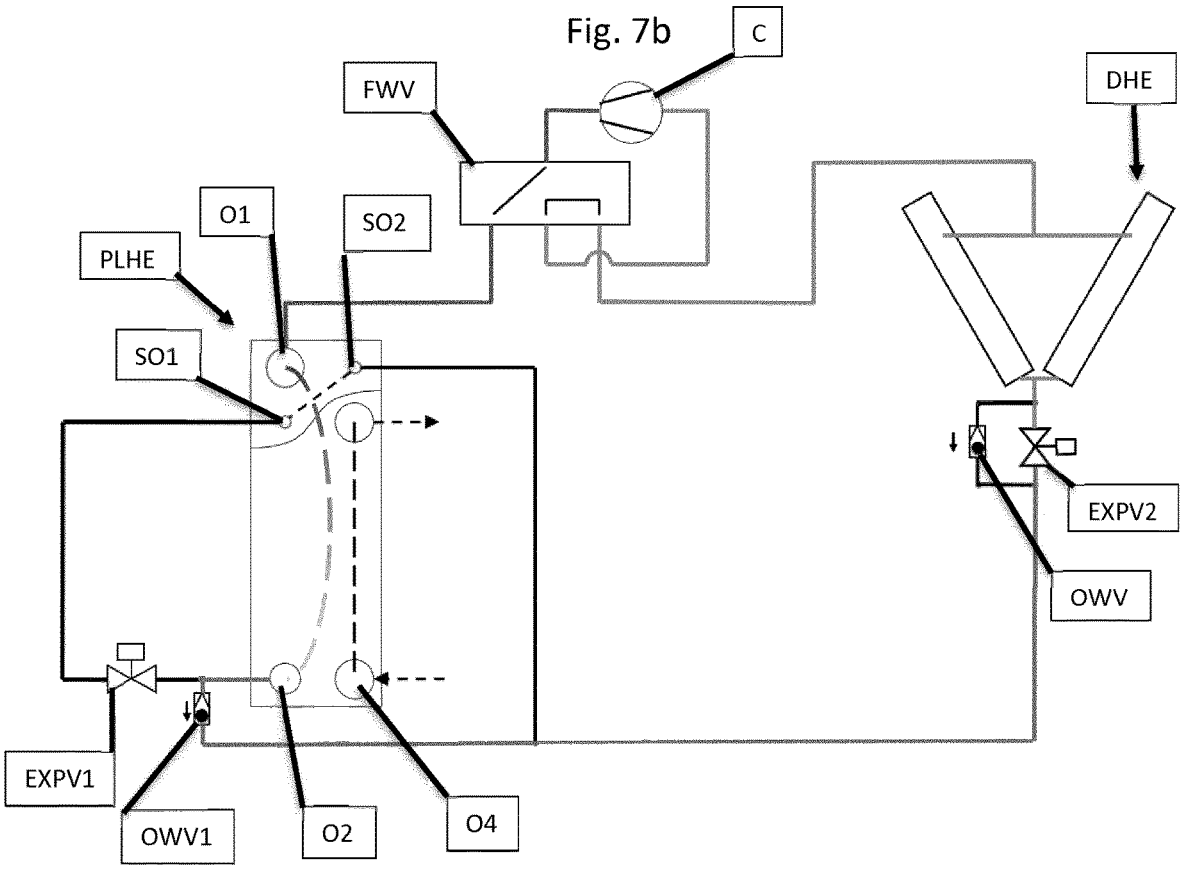
FIG. 7*b* is a schematic view of another embodiment of a reversible refrigeration system.

In FIG. 7*b*, a second embodiment of a reversible refrigeration system is shown. In general, this system is similar to the system shown in FIGS. 6 and 7, however with the difference that the dump heat exchanger DHE is not provided with a suction gas heat exchanging function. Also, the dump heat exchanger according to this embodiment is an outside air/refrigerant heat exchanger. Such heat exchangers are often used when it is not possible to dump the heat in e.g. a brine solution. Generally, air/refrigerant heat exchangers function in cross-current mode, meaning that the benefit of connecting an air/refrigerant heat exchanger to a suction gas heat exchanger in the manner disclosed for both the payload heat exchanger (PLHE) and the dump heat exchanger DHE.

In FIG. 7*b*, the reversible refrigeration system is shown in a heating mode, i.e. the payload heat exchanger functions as a condenser. Gaseous refrigerant is compressed in the compressor C and conveyed to the large opening O1, from which it will pass the payload heat exchanger PLHE and exchange heat with a medium requiring heating, i.e. the payload. The heat exchange will take place in a counter-current mode. The refrigerant, now liquid, will thereafter pass the one-way valve OWV1 and thereafter pass the expansion valve EXPV2, in which the refrigerant pressure will decrease, resulting in a corresponding decrease of boiling temperature. The decrease of the boiling temperature will enable the refrigerant to vaporize in the dump heat exchanger DHE by heat exchange with outside air, which in this embodiment will function as the heat dump. The evaporated, i.e. gaseous refrigerant will thereafter be conveyed to the compressor C, which again will compress the refrigerant. It should be noted that in this mode, i.e. when the four-way valve FVW is in the heating position, there will be no or only a minor flow of refrigerant between the small openings SO1 and SO2. Hence, there will be no heat exchange in this part of the heat exchanger.

The reversible refrigeration system of FIG. 7*b* may also be used in the reverse mode, just like the embodiment shown in FIGS. 6 and 7. In this mode, compressed refrigerant is directed to the dump heat exchanger DHE. Just like in the embodiment shown in FIGS. 6 and 7, this is achieved by switching the four-way valve FWV. In the dump heat exchanger, the high pressure gaseous refrigerant will exchange heat with the outside air, and as a result, the refrigerant will condense. The condensed refrigerant will leave the dump heat exchanger and pass the one-way valve OWV1 (which allows for a flow in this direction). Then, the refrigerant will be transferred to the small opening SO2 of the payload heat exchanger PLHE, and, under heat exchange with cold gaseous refrigerant, pass the pay-load heat exchanger PLHE under heat exchange with cold, gaseous refrigerant about to leave the payload heat exchanger PLHE.

Figure 8:
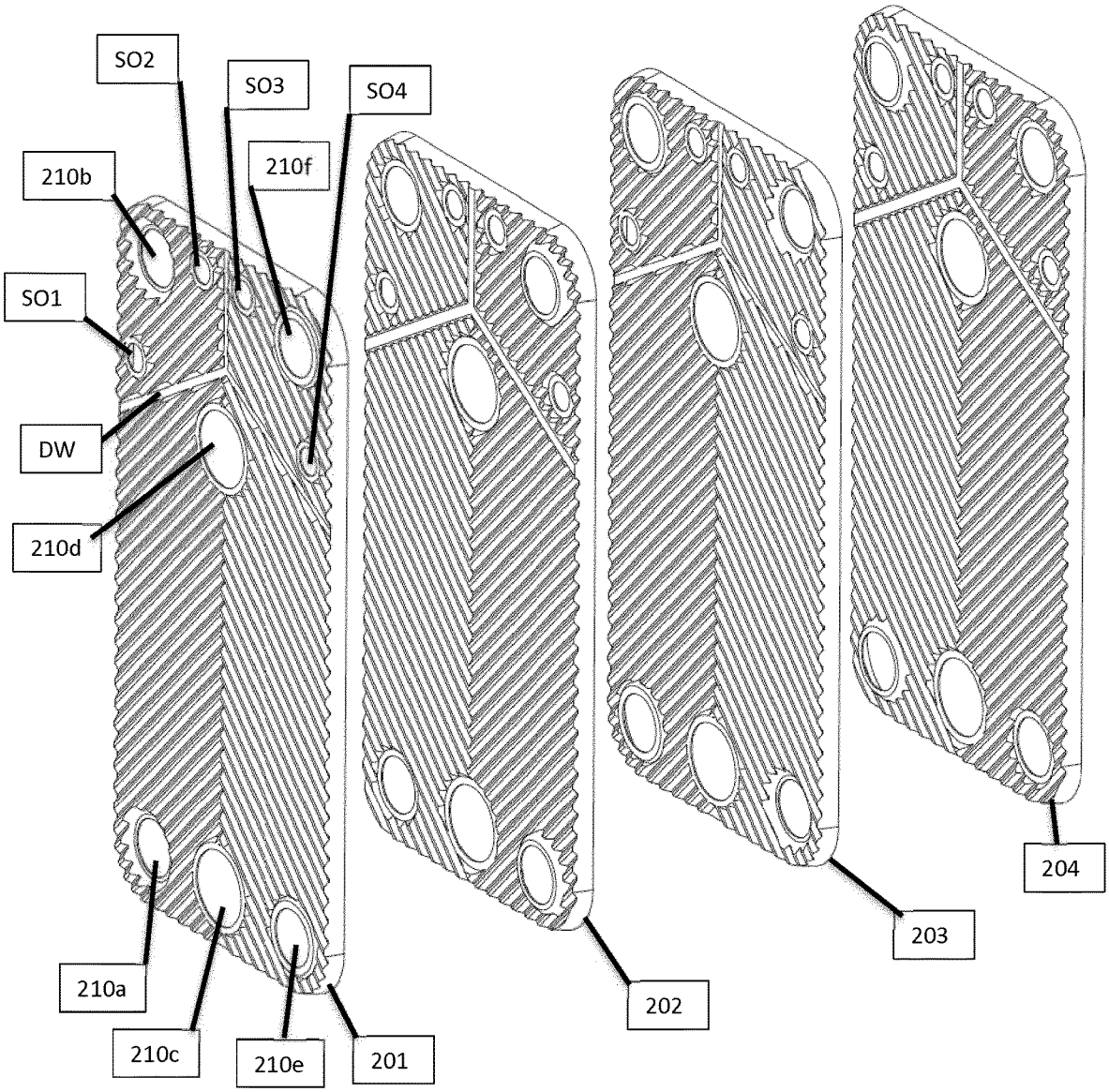
FIG. 8 is a schematic view of four heat exchanger plates comprised in a "multi circuit" heat exchanger.

In still another embodiment, at least one integrated suction gas heat exchanger is provided in a so-called "multi circuit" heat exchanger, such as schematically shown in FIG. 8. A multi circuit heat exchanger is a heat exchanger having inlet and outlet port openings for three different media to exchange heat, i.e. six port openings.

In FIG. 8, an exemplary embodiment of a plate and port arrangement in a multi circuit heat exchanger 200 with integrated suction gas heat exchange possibility is shown. In the shown embodiment, four plates 201, 202, 203, 204 are each provided with six large port openings 210*a*-210*f* and a pressed pattern of ridges R and grooves G adapted to keep the grooves on a distance from one another when the plates are stacked on top of one another, such that interplate flow channels for media to exchange heat are formed between the heat exchanger plates 210*a*-210*f*. The port openings 210*a*-210*f* are provided at different heights, such that selective fluid communication between the port openings and the interplate flow channels is obtained.

In the present case, the port openings 210*a* and 210*b* are provided at the same height, meaning that they will communicate with the plate interspace between the plates 201 and 202. The port openings 210*c* and 210*d* are communicating with the plate interspace between the plates 202 and 203 and the port openings 210*e* and 210*f* communicate with the plate interspace between the plates 203 and 204.

Moreover, dividing surfaces DW are provided such that the interplate flow channels between the plates 202 and 203 is sealed off for communication, hence forming first and second heat exchanging portions that communicate with small port openings SO1-SO4, wherein the small port openings SO1 and SO2 communicate with the heat exchanging portion being located closest to the port opening 210*b* and wherein the small port openings SO3 and SO4 communicate with the heat exchanging portion being located closest to the port opening 210*f*.

Usually, a multi circuit heat exchanger is used where the requirements for heating and/or cooling varies within wide boundaries. In a typical setup, every other interplate flow channel (the channels communicating with the port openings 210*c* and 210*d*) is arranged for a flow of brine solution, wherein one of its neighbouring interplate flow channels is arranged for a flow of a first refrigerant and its other neighboring flow channel is arranged for a flow of a second refrigerant. The first and second refrigerants are connected to separate refrigeration systems, each having its own compressor and expansion valve. When high power cooling or heating is required, both compressors are energized, whereas only one compressor is energized when the cooling or heating requirement is lower.

A multi circuit heat exchanger can be used in basically the same way as disclosed above with reference to FIGS. 6 and 7, however with dual compressors C, dual expansion valves EXPV1, dual expansion valves EXPV2, dual four-way valves FWV, dual one-way valves OWV1 and dual one-way valves OWV2.

Figure 9:
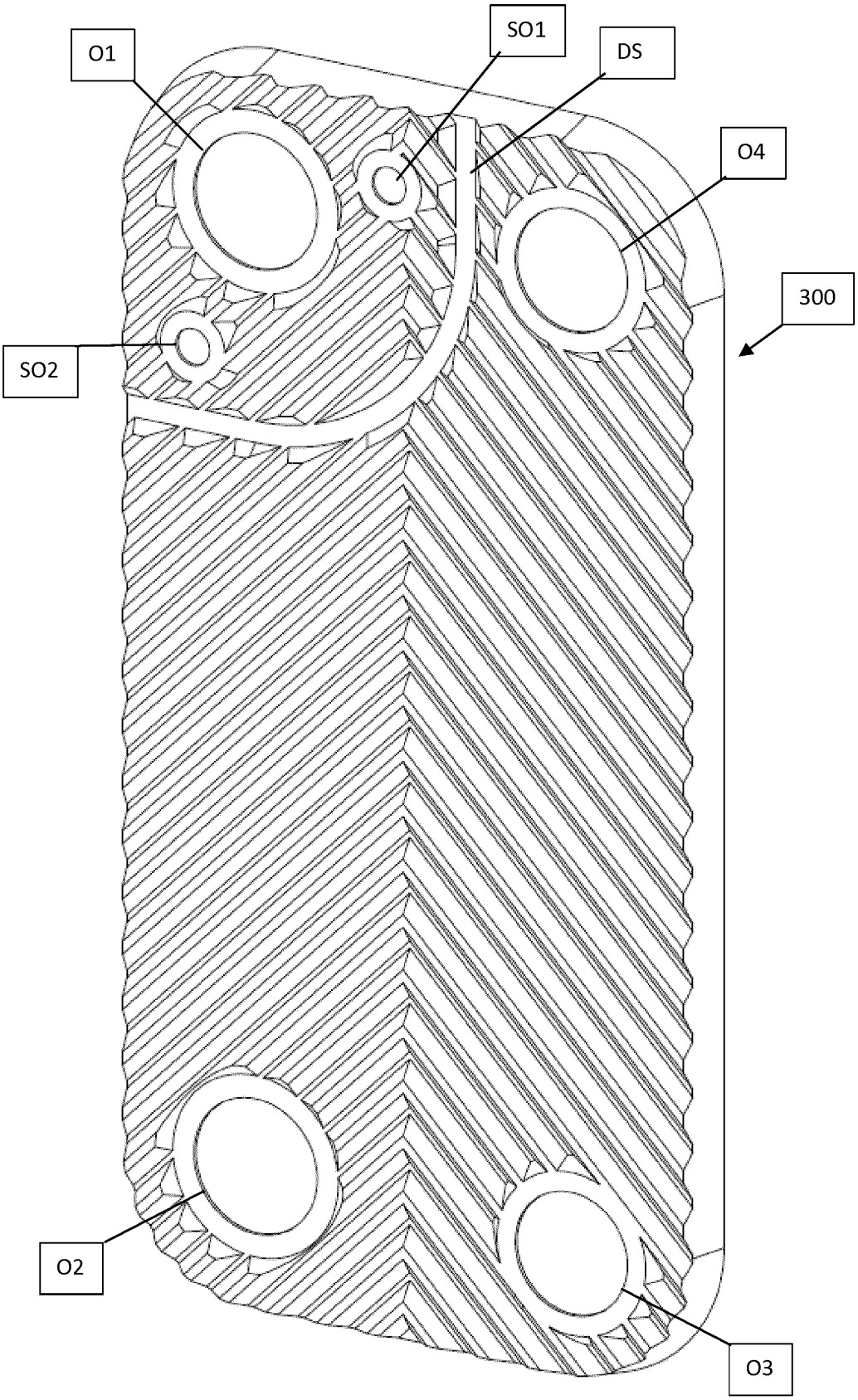
FIG. 9 is a schematic perspective view of a heat exchanger plate according to a preferred embodiment.

In FIG. 9, another embodiment of a heat exchanger plate 300 is shown. The heat exchanger plate 300 according to this embodiment comprises four port openings O1-O4, which are in fluid communication with one another in the same way as the port openings O1 to O4 of the plate of FIG. 2. However, in contrast to the heat exchanger plate of FIG. 1, the port openings O1 to O4 are placed near comers of the heat exchanger plate 300. Moreover, small port openings SO1 and SO2 are provided in the vicinity of one another and they communicate with one another in the same way as the small port openings of the heat exchanger plates 210*a*, 210*b* of FIG. 2. Also, there is a dividing surface DS provided on the heat exchanger plate 300, the dividing surface DS extending between two neighbouring sides of the heat exchanger plate 300; in case the heat exchanger plate is elongate, the dividing surface DS will extend between one long side and one short side of the heat exchanger plate 300, hence partly encircling a port opening O1-O4. In contrast to the heat exchanger plates shown in FIG. 4, the dividing surface DW of the embodiment of FIG. 9 is not entirely circular. Rather, ends of the dividing surface SW are straight, meaning that they will connect to the sides of the heat exchanger in a perpendicular or close to perpendicular fashion.

Figure 10:
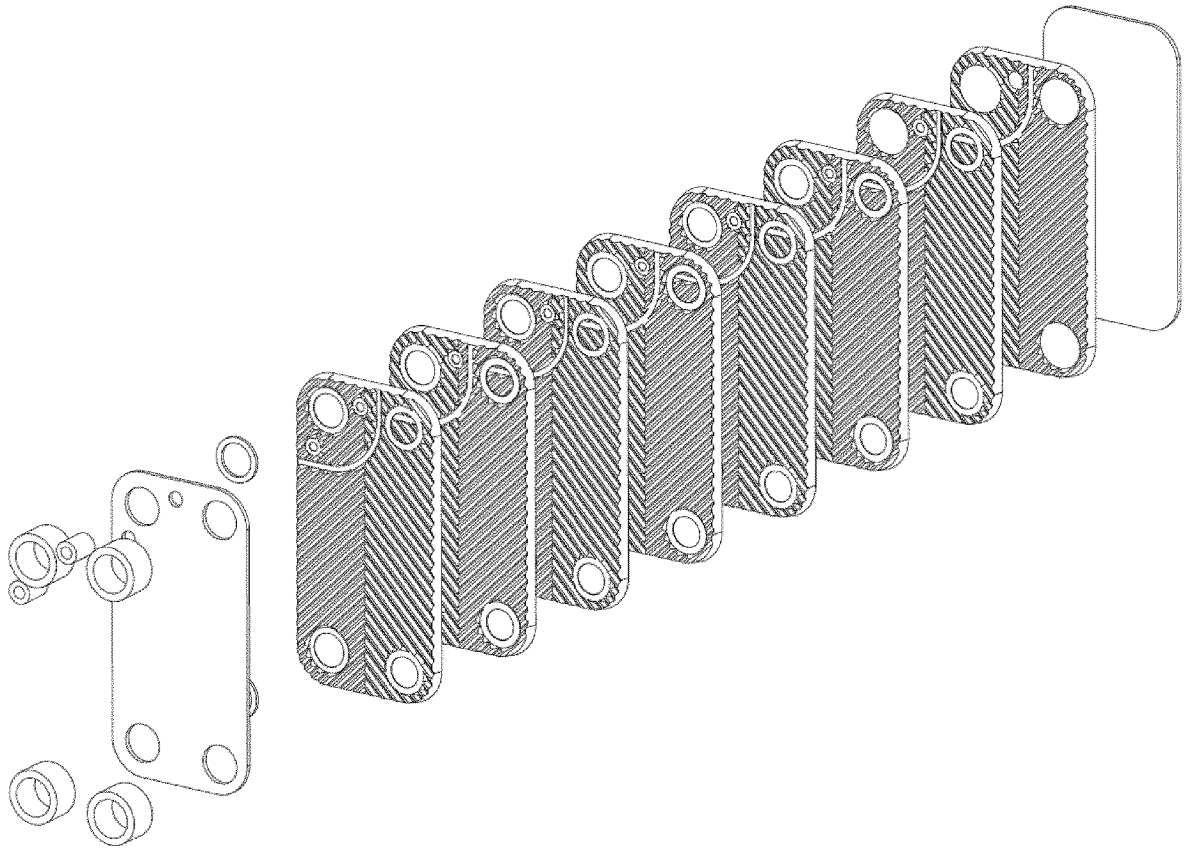
FIG. 10 is an exploded perspective view of a heat exchanger comprising the heat exchanger plate of FIG. 9.

In FIG. 10, an exploded view of a heat exchanger comprising heat exchanger plates according to FIG. 9 is shown. It has the same function as described above with reference to FIGS. 1-2. However, the heat exchanger plate embodiment of FIGS. 9 and 10 has the advantage of providing an equal flow area over the length between the small port openings SO1 and SO2.

The invention claimed is:

1. A brazed plate heat exchanger comprising a number of rectangular or square heat exchanger plates provided with a pressed pattern of ridges and grooves adapted to keep the plates a distance from one another by providing contact points between crossing ridges and grooves of neighbouring plates under formation of a first interplate flow channel and a second interplate flow channel for media to exchange heat, (a) wherein said interplate flow channels being in selective fluid communication with a first large port opening, a second large port opening, a third large port opening, a fourth large port opening, a first small port opening, and a second small port opening for letting in fluids to exchange heat, (b) wherein fluid passing between the first large port opening and the second large port opening in the first interplate flow channel exchanges heat with both fluid passing between the third large port opening and the fourth large port opening over a first heat exchanging portion of each plate and fluid passing between the first small port opening and the second small port opening over a second heat exchanging portion of each plate, wherein the first heat exchanging portion and the second heat exchanging portion forms the second interplate flow channel, and (c) wherein said first heat exchanging portion and said second heat exchanging portion being divided by a dividing surface extending between and connecting neighboring sides, wherein the neighboring sides extend 90° to one another, of the rectangular or square heat exchanger plates so that the fluid in the first heat exchanging portion is separate from the fluid in the second heat exchanging portion.

2. The heat exchanger of claim 1, said dividing surface comprising a ridge of one heat exchanger plate and a groove of its neighboring plate, such that a seal between the plates is achieved when the ridge of the one heat exchanger plate contacts the groove of the neighbouring heat exchanger plate and no seal is achieved when the ridge of the one heat exchanger plate does not contact the groove of its neighboring plate.

3. The heat exchanger of claim 1, wherein the second portion extends along a radius of a part of one of the first large port opening, the second large port opening, the third large port opening, or the fourth large port opening.

* * * * *